United States Patent [19]

Eastman

[11] 4,212,347

[45] Jul. 15, 1980

[54] UNFURLABLE HEAT PIPE

[75] Inventor: George Y. Eastman, Lancaster, Pa.

[73] Assignee: Thermacore, Inc., Leola, Pa.

[21] Appl. No.: 971,404

[22] Filed: Dec. 20, 1978

[51] Int. Cl.[2] ..... F28D 15/00

[52] U.S. Cl. ..... 165/46; 165/86; 165/105; 29/157.3 R

[58] Field of Search ..... 165/105, 46, 86; 29/157.3 R

[56] References Cited

U.S. PATENT DOCUMENTS

| | | | |
|---|---|---|---|
| 3,450,195 | 6/1969 | Schnacke | 165/105 X |
| 3,490,718 | 1/1970 | Vary | 165/105 X |
| 3,496,995 | 2/1970 | Rosen et al. | 165/105 X |
| 3,604,503 | 9/1971 | Feldman, Jr. et al. | 165/105 X |
| 3,931,532 | 1/1976 | Byrd | 165/105 X |

*Primary Examiner*—Albert W. Davis
*Attorney, Agent, or Firm*—Martin Fruitman

[57] ABSTRACT

A heat pipe which can be rolled up for storage and automatically deploys when heat is applied. Two highly flexible parallel sheets are bonded together at their edges, thus permitting compact rolled storage. The inside portions of the joined edges form creases which act as capillary channels to move the heat exchange liquid from the condenser to the evaporator. A further embodiment involves multiple longitudinal cells which yield many more capillary channels and increases the structural strength of the deployed heat pipe, while maintaining the large surface area for heat transfer.

4 Claims, 3 Drawing Figures

UNFURLABLE HEAT PIPE

BACKGROUND OF THE INVENTION

This invention relates generally to heat transfer and more specifically to systems with an intermediate fluid which transfer heat by evaporating and condensing, known in the art as heat pipes.

The need for efficient heat transfer devices for systems traveling in outer space is well established. Because heat transfer remote from the atmosphere must depend almost completely upon radiation, a frequent goal has been that of maximizing surface area while minimizing the weight and volume occupied during the time when the system is being lifted into space.

One approach to that goal is shown in U.S. Pat. No. 3,496,995 in which a conventional, pumped liquid heat exchange system uses adjacent parallel unfurlable tubes through which cooling liquid is circulated. A second approach in the same patent uses an evaporating-condensing system in an unfurlable tube, but requires gravity to return the condensed liquid to the evaporator. Such systems, requiring either a mechanical pump or a gravity environment, do not satisfactorily fulfill the need for a heat exchange system for space use which is both light weight and gravity independent.

It is therefore an object of this invention to furnish an unfurlable evaporating-condensing heat exchanger which can operate independent of gravity and independent of its orientation relative to any pseudo-gravity, such as that created by centrifugal force.

It is a further object of this invention to provide a structurally self-supporting heat transfer panel with essentially isothermal design, which can be stored rolled up, and will unfurl automatically when heat is applied to the exposed end.

It is a still further object of this invention to provide an unfurlable heat transfer system which is capable of transferring heat bi-directionally and in which both ends may function as either evaporators or condensers.

SUMMARY OF THE INVENTION

These and other objectives may be met by the use of the invention described herein where the preferred embodiment is a thin walled heat pipe constructed of essentially parallel planes of heat conductive material. These parallel planes are joined at their edges by bonding their facing surfaces, and therefore the joint creates no structural resistance to rolling the structure up. Storage of the heat pipe can then be accomplished by rolling up the structure, which acts no differently than two simple sheets of material laid together, and the resulting volume is a relatively small cylinder with a length equal to the width of the original surface.

The fluid in such a heat pipe is naturally forced into the unrolled edge during the rolling process. When the exposed edge is subjected to heat, the vapor pressure built up by the heated fluid can be used to force the heat pipe to unfurl.

The particular construction of the bonded edges of the heat pipe provides its gravity independent and bi-directional heat flow characteristics. The two planes bonded together on their facing surfaces form a crevice-like space at the junction of their surfaces which acts as a capillary channel to transport liquid. This movement of liquid is automatic and is always directed from the area of the condenser to the evaporator section of the heat pipe. Since liquid movement is accomplished by capillary action, no gravity orientation is required. Moreover, regardless of how much the planar surfaces may separate in their central regions, the edges always maintain some capillary flow.

A second embodiment of the invention involves a multicellular construction, in which the planar surfaces are divided into sections, each completely independent of the others, by bonding the planes together at the boundary areas of the cells. Such a construction increases the number of capillary channels available for liquid transport, permitting the capillary flow capability to be increased to whatever level is desired.

The multicell structure also yields two other clear benefits. The multiple bonded areas increase the structural strength of the configuration in such a manner that bulging of the center portion of the cell is reduced, while very little resistance to roll-up is added. Such reduced separation of the sheets, therefore, permits each crevice capillary channel to carry more liquid along with the increased liquid flow due to more capillary channels.

Moreover, the multiple independent cells add a redundancy to the structure which yields increased reliability, particularly for space applications, where meteorite penetration of a unit constructed as a single heat pipe would completely destroy the heat transfer function. The multiple cell construction permits continued partial operation of the heat transfer unit. The more sections into which the heat transfer system has been divided, of course, the closer operation will be to full efficiency despite a single malfunction.

DETAILED DESCRIPTION OF THE INVENTION

Figure 1:
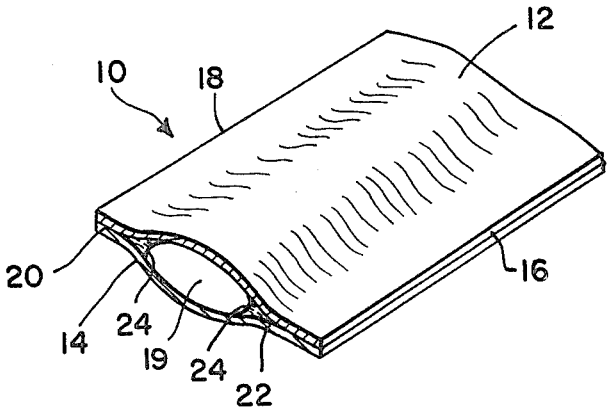
FIG. 1 is a partial cross-sectional view of the preferred embodiment of the invention.

The preferred embodiment of the invention is shown in FIG. 1 where heat pipe 10 is constructed with heat conductive upper sheet 12 and lower sheet 14 bonded together with their inside surfaces in contact at edges 16 and 18. This configuration forms enclosed volume 19 and capillary channels 20 and 22 in the resulting crevices. Heat exchange liquid 24 is transported from the condenser section of the heat pipe to the evaporator section in capillary channels 20 and 22 by conventional capillary forces.

Figure 2:
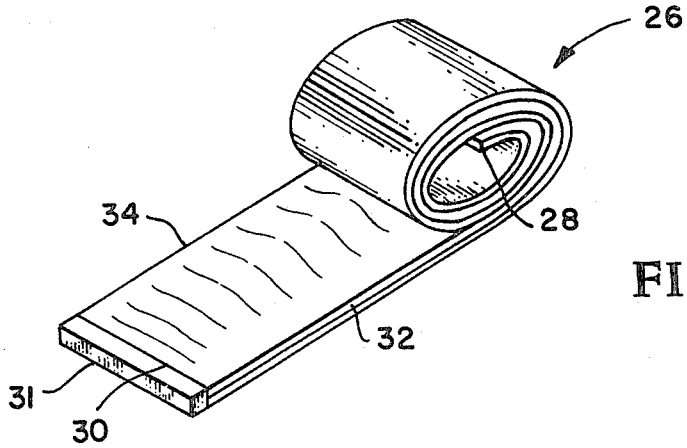
FIG. 2 is a perspective view of the preferred embodiment in a partially rolled up condition.

Sheets 12 and 14 are formed of very thin, particularly flexible material such as aluminum foil which gives little resistance to coiling heat pipe 26 by rolling it up using one edge 28 for an axis, as shown in FIG. 2. In such a configuration the condensed heat exchanger fluid is forced back into the uncoiled end 30. When end plate 31 is heated, or when an object (not shown) to which it is bonded for cooling purposes begins to generate heat, the heat exchange liquid in uncoiled end 30 vaporizes, and the vapor pressure itself causes heat pipe 26 to unfurl and begin functioning as a conventional heat pipe. The capillary channels inside edges 32 and 34 permit the liquid condensed at cooler end 28 of the unfurled heat pipe to move back to heated end 30 in the absence of gravitational forces.

End plate 31 serves a function in addition to merely terminating the heat pipe. It is used as a structural member which aids in maintaining the shape of enclosed volume 19 of FIG. 1 and thereby aids in maintaining optimum capillary channels. Since any considerable separation of sheets 12 and 14 causes a reduction in the length of edge 30, bonding edge 30 to structural member 31 prevents its contraction and thereby resists bowing.

Figure 3:
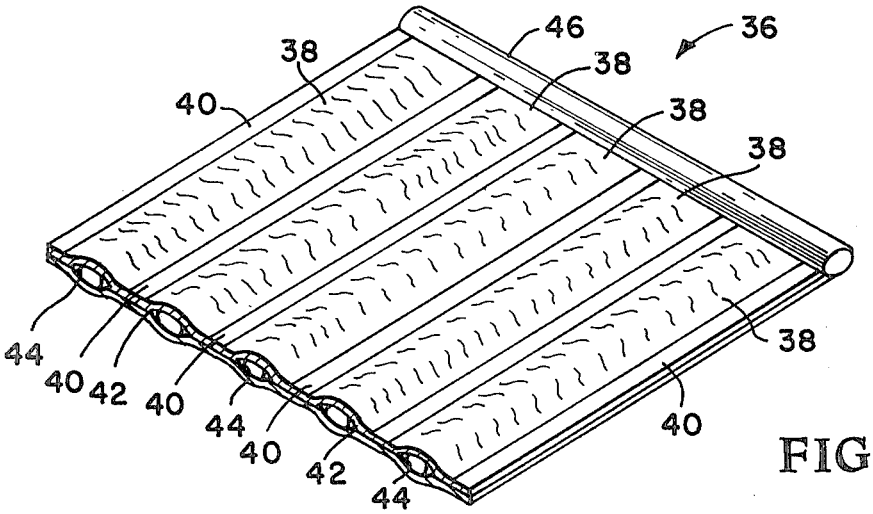
FIG. 3 is a partial cross-sectional view of an alternate embodiment of the invention.

FIG. 3 depicts an alternate embodiment of the invention in which the structural panel 36 is divided into several cells 38 alternating with bonded areas 40. In such an embodiment, multiple bonded areas 40 of the sheets add to the structural strength of panel 36, and they prevent excessive bowing of cells 38 while adding little resistance in the required direction of roll up. Crevices 42 are thereby better maintained to permit capillary flow of liquid 44.

As more cells 38 are added to the structure the redundancy of the units also increases the reliability. Any puncture of a single cell, as, for instance, by a meteorite, has no effect on the other nearby cells, since each heat pipe cell 38 is a sealed unit and acts completely independent of all the others.

Structural member 46, shown attached to one end of multiple cell structural panel 36, aids in reducing bowing in cells 38 just as structural member 31 acts in the single cell embodiment of FIG. 2.

It is to be understood that the forms of the invention herein shown are merely preferred embodiments. Various changes may be made in the size, shape and the arrangement of parts; equivalent means may be substituted for those illustrated and described; and certain features may be used independently from others without departing from the spirit and scope of the invention as defined in the following claims.

What is claimed as new and desired to be secured by Letters Patent of the United States is:

1. A gravity independent heat pipe which can be rolled up comprising:

two flexible heat conductive sheets bonded together at the edges of their facing surfaces to form an enclosed volume between them, said bonds forming crevices on the perimeter of the enclosed volume which serve as capillary channels; and heat exchange fluid, selected to vaporize and condense in the range of temperatures anticipated for operation of the heat pipe, contained within the enclosed volume.

2. A gravity independent heat pipe as in claim 1 which can be rolled up, further comprising a structural member attached to both sheets along an edge which does not act to form a capillary channel, said structural member aiding in maintaining the shape of the enclosed volume with optimum capillary channels.

3. A gravity independent heat pipe which can be rolled up comprising:

two flexible heat conductive sheets bonded together at the edges of their facing surfaces, and at least one additional bond, said additional bond oriented to run approximately parallel to the bonds at one set of opposite edges, said bonds forming at least two enclosed volumes between the several bonds and also forming crevices at the junction lines between the bonds and the enclosed volumes, said crevices serving as capillary channels; and heat exchange fluid, selected to vaporize and condense in the range of temperatures anticipated for operation of the heat pipe, contained within the enclosed volumes.

4. A gravity independent heat pipe as in claim 3 which can be rolled up, further comprising a structural member attached to both sheets along an edge which does not act to form a capillary channel, said structural member aiding in maintaining the shape of the enclosed volumes with optimum capillary channels.

* * * * *